US007727125B2

(12) United States Patent
Day

(10) Patent No.: US 7,727,125 B2
(45) Date of Patent: Jun. 1, 2010

(54) EXERCISE MACHINE AND METHOD FOR USE IN TRAINING SELECTED MUSCLE GROUPS

(76) Inventor: Franklin J. Day, 365 Pimlico Dr., Walnut Creek, CA (US) 94596

( * ) Notice: Subject to any disclaimer, the term of this patent is extended or adjusted under 35 U.S.C. 154(b) by 1398 days.

(21) Appl. No.: 10/979,493

(22) Filed: Nov. 1, 2004

(65) Prior Publication Data

US 2006/0094569 A1 May 4, 2006

(51) Int. Cl.
*A63B 22/06* (2006.01)

(52) U.S. Cl. ..... 482/63; 482/5

(58) Field of Classification Search ..... 482/1, 482/2, 4, 5, 8, 9, 57, 63, 64, 900, 901, 902; 434/61, 247; 601/36
See application file for complete search history.

(56) References Cited

U.S. PATENT DOCUMENTS

| | | | |
|---|---|---|---|
| 87,769 | A | 3/1869 | Gardner |
| 88,574 | A | 4/1869 | Lindon |
| 241,395 | A | 5/1881 | McKenzie |
| 302,090 | A | 7/1884 | Bernhard |
| 328,353 | A | 10/1885 | Starr |
| 433,720 | A | 8/1890 | Chace |
| 483,495 | A | 9/1892 | Hunter |
| 564,408 | A | 7/1896 | Condon |
| 611,764 | A | 10/1898 | Arnold |
| 1,058,123 | A | 4/1913 | Whitaker |
| 3,360,263 | A | 12/1967 | Tsuru |
| 3,501,142 | A | 3/1970 | Johansson |
| 3,820,820 | A | 6/1974 | Kutz |
| 3,877,724 | A | 4/1975 | Chase |
| 3,884,317 | A | 5/1975 | Kinzel |
| 3,994,509 | A | 11/1976 | Schaeffer |
| 4,148,478 | A | 4/1979 | Moyski et al. |
| 4,379,566 | A | 4/1983 | Titcomb |
| 4,453,729 | A | 6/1984 | Lucken |
| 4,456,247 | A | 6/1984 | Ehrenfried |
| 4,477,072 | A | 10/1984 | DeCloux |
| 4,519,603 | A | 5/1985 | DeCloux |
| 4,533,136 | A | 8/1985 | Smith et al. |
| 4,538,826 | A | 9/1985 | Lemarie |

(Continued)

FOREIGN PATENT DOCUMENTS

| | | |
|---|---|---|
| FR | 2460834 | 1/1981 |

OTHER PUBLICATIONS

PowerCranks, Brochure printed from www.powercranks.com, 2 pages.

(Continued)

*Primary Examiner*—Loan H Thanh
*Assistant Examiner*—Tam Nguyen
(74) *Attorney, Agent, or Firm*—Chernoff, Vilhauer, McClung & Stenzel, LLP

(57) ABSTRACT

An exercise machine and a method for its use in training selected muscle groups by controlled use of brakes to resist crank movement adjustably at specific and adjustable controlled positions in the rotation of a crank. A control system may be incorporated to cause brake mechanisms to apply varying amounts of resistance to a pair of pedal-driven cranks to simulate the efforts required to ride an actual bicycle over a course including various upslopes and down-slopes.

37 Claims, 6 Drawing Sheets

U.S. PATENT DOCUMENTS 4,639,007 A 1/1987 Lawrence
4,647,036 A 3/1987 Huszczuk
4,657,273 A 4/1987 Slater
4,749,182 A 6/1988 Duggan
4,757,988 A 7/1988 Szymski
4,762,332 A 8/1988 Seol
4,838,544 A 6/1989 Sasakawa et al.
4,842,269 A 6/1989 Huang
4,881,732 A 11/1989 Kepiro
4,925,200 A 5/1990 Jones
4,934,692 A * 6/1990 Owens ..... 482/63
4,938,474 A 7/1990 Sweeney
4,957,282 A 9/1990 Wakefield
5,016,870 A 5/1991 Bulloch et al.
5,016,871 A 5/1991 Dalebout et al.
5,083,772 A * 1/1992 Brown ..... 482/59
5,088,340 A 2/1992 Seol
5,125,677 A 6/1992 Ogilvie et al.
5,184,837 A 2/1993 Alexander
5,228,709 A 7/1993 Kao
5,240,417 A * 8/1993 Smithson et al. ..... 434/61
5,256,117 A 10/1993 Potts et al.
5,256,124 A 10/1993 Hughes
5,279,529 A 1/1994 Eschenbach
5,299,993 A 4/1994 Habing
5,342,262 A 8/1994 Hansen
5,351,575 A 10/1994 Overby
5,374,227 A 12/1994 Webb
5,387,167 A 2/1995 Johnston
5,390,773 A 2/1995 Proia
5,403,255 A 4/1995 Johnston
5,433,680 A 7/1995 Knudsen
5,447,479 A 9/1995 Gvoich
5,496,238 A * 3/1996 Taylor ..... 482/63
5,499,956 A 3/1996 Habing et al.
5,514,053 A 5/1996 Hawkins
5,573,481 A 11/1996 Piercy et al.
5,626,539 A 5/1997 Paiget et al.
5,647,821 A 7/1997 Johnston
5,722,915 A * 3/1998 Reck ..... 482/2
5,735,774 A 4/1998 Maresh
5,795,270 A 8/1998 Woods et al.
5,810,696 A 9/1998 Webb
5,860,329 A 1/1999 Day
5,910,072 A 6/1999 Rawls et al.
5,984,335 A 11/1999 Tseng
6,234,939 B1 * 5/2001 Moser et al. ..... 482/63
6,280,363 B1 8/2001 Harrell
6,290,629 B1 9/2001 Vargas, III et al.

OTHER PUBLICATIONS

Whitt & Wilson, Bicycling Science, 1995, pp. 63 and 281.
Gross, et. al., "The Aerodynamics of Human-Powered Land Vehicles," Scientific American, Dec. 1993.

* cited by examiner

EXERCISE MACHINE AND METHOD FOR USE IN TRAINING SELECTED MUSCLE GROUPS

BACKGROUND OF THE INVENTION

The present invention relates to exercise machines, and in particular relates to an exercise machine incorporating one or more cranks and a method for use of such a machine in training selected muscle groups for athletic or therapeutic purposes.

Exercise machines are well known in which handles or pedals are used to drive cranks connected to flywheels or fans that provide resistance to rotation of the cranks. Various brakes or other mechanisms are used in other exercise machines to provide desired amounts of resistance to rotation of the cranks, varying the resistance in response to operator control, as taught by Owens U.S. Pat. No. 4,934,692, or in response to the length of time during which the exercise machine is operated, or in response to the number of rotations of the crank, as in Johannson U.S. Pat. No. 3,501,142. While such exercise machines are useful in improving the fitness of a healthy user, they are not particularly useful in providing training for rehabilitation of specific muscle groups in injured users or athletes trying to improve function of specific muscles or to improve a particular coordination pattern.

Even though every joint has two sets of muscles working about that joint (generally referred to as the agonist and the antagonist muscles; as they work in opposite directions) for most exercise machines most of the benefit has been to one set of muscles in the legs, the anti-gravity muscles (the hip and knee extensor muscles), and not to their antagonists, the other major set of leg muscles, the hip and knee flexors.

Bicycles and stationary exercise machines which utilize a pair of fixedly opposed cranks driving a flywheel require an initial effort to overcome the inertia of the flywheel or cycle and continued effort thereafter to overcome the continuing effects of friction usually provided by an adjustable brake. A pair of opposed cranks continuously connected to a flywheel, however, may result in flywheel inertia, or torque applied to one crank, being used to make up for weakness of injured muscles working on the opposite crank. As a result, muscles that need to be trained are not forced by the machine to work as much as might be desirable.

Recently there have been attempts to address this weakness of the bicycle and previously known exercise machines, and three recent patents are of note in this regard: Moser, et. al. U.S. Pat. No. 6,234,939, Day U.S. Pat. No. 5,860,329, and Taylor U.S. Pat. No. 5,496,238. The patents of Moser and Day both teach making the two pedals of the bicycle or exercise machine independent from each other to force the use of and thus provide for training of the hip and knee flexor muscles in the pedaling motion, although these two inventors went about this in different ways.

Moser's device, although claiming to be useful for bicycles, gives a description of only a stationary exercise device and achieves its end through dual right and left drive mechanisms. While it would be possible to put such a system on a bicycle it would require substantial modification of a typical bicycle.

Day's solution, while claiming to be useful for an exercise machine, gives a description only of a mechanism to attach to a standard bicycle to make the cranks independent, and it achieves its end by using independent cranks to move a single drive mechanism. Moser's device does describe allowing the user to choose different resistances for the right and left legs on a stationary exercise machine although he does not describe how one would do so on a bicycle. Neither Day nor Moser, et. al. provides significant resistance when pedaling backwards.

The device disclosed by Taylor is specifically intended to train the hip and knee flexor muscles in an independent pedaling apparatus that specifically adds resistance on the "up stroke" of the pedaling motion, but that deliberately provides less resistance on the "down stroke," just the opposite of most cycle type exercise machines.

Some exercise machines are intended to simulate the exercise requirements of an actual bicycle ride, as by increasing braking against crank rotation to simulate climbing a hill, and decreasing braking in order to simulate descending a hill. Such previously available stationary exercise machines, however, fail to realistically simulate many of the variable requirements for effort experienced while actually riding a bicycle, such as needing to overcome the mass inertia of the rider when accelerating or decelerating and the tendency of the bicycle to accelerate when going downhill, even when not pedaling, and improvements are desired.

While some variable resistances are present in currently available exercise machines, many do not simulate the inertia of the bike/rider system which would require the user to put in enough excess energy in order to accelerate. Such system inertia would require approximately 30 seconds for a rider to accelerate to top speed, as in real world riding, compared to the 3-5 seconds it takes on currently available exercise machines where this inertia is ignored or attempted to be simulated with a large flywheel.

Another simulation defect of current machines is the inability to simulate the speeding up that occurs when coasting down hill without attempting to accelerate.

It is therefore desired to provide an exercise machine in which resistance to cranking can be varied for the purpose of training specific muscle groups, and methods for use of such a machine to train selected muscle groups and to simulate more realistically the experience of riding an actual bicycle over varying terrain.

SUMMARY OF THE INVENTION

The present invention provides an answer to the above-mentioned desire for improved exercise machines, as is defined by the following claims.

In particular, the present invention provides an exercise machine which controllably provides resistance to movement of a crank, and that controllably varies resistance to crank movement in response to one or more of several considerations that may include crank position, direction of crank motion, crank speed, and crank acceleration, in order to provide an amount of resistance to the motion of one or each of the cranks where and when such resistance will be most useful in providing exercise to improve the user's fitness. In an exercise machine which is one preferred embodiment, resistance is varied during each crank rotation so as to provide the most desirable resistance in an angular sector of each rotation where it will be most useful to train selected specific muscle groups of the user, or in simulating the varying requirements for efforts during an actual bicycle ride.

In an exercise machine embodying one aspect of the invention resistance to crank rotation is varied during every crank rotation in response to direction of crank rotation, speed of crank movement, and crank position.

In an apparatus which is one preferred embodiment of the present invention, a rotating element may be driven by a crank, and varying resistance to rotation of the crank may be provided controllably by a braking mechanism operated by a control system and acting on the rotating element to provide selected amounts of resistance in response to sensor signals indicative of one or more of crank position, crank speed, crank direction, crank acceleration, elapsed time, and total angular movement of the crank.

In an exercise machine which is a preferred embodiment, sensors are provided to detect at least one of crank position, speed, and direction of crank movement, and to detect and indicate how much force is being applied effectively to a crank, in a tangential direction with respect to crank rotation. In such an exercise machine machine-readable representation signals are preferably provided electrically to a controller.

In one preferred embodiment of the invention, a control system is utilized to operate a brake mechanism to provide desired amounts of resistance to crank rotation at desired times and crank positions so as to require more or less application of force by specific muscles or muscle groups, in order to train those muscles.

In one preferred embodiment of the invention, such a control system is arranged to provide resistance to rotation of a pair of cranks in a way that simulates the resistance to pedal movement experienced by a bicyclist during a bicycle ride on terrain of varying slopes and allows the user to regulate the amount of resistance by providing a signal that causes the control system to simulate the result of shifting the gears of a bicycle to respond to the slopes of the terrain or desired speed or effort on that terrain. For example, downhill slopes can be simulated by applying no resistance to crank rotation as long as crank speed is less than would be necessary to further accelerate the bicycle moving at the simulated speed using a simulated gearing selection. In this way "coasting" under any condition can be appropriately simulated.

In a preferred embodiment, each of a pair of cranks may be rotated separately about a single axis of rotation and resistance to rotation is provided separately in individually regulated amount for each crank.

The foregoing and other objectives, features, and advantages of the invention will be more readily understood upon consideration of the following detailed description of the invention taken in conjunction with the accompanying drawings.

BRIEF DESCRIPTION OF THE SEVERAL DRAWINGS

Figure 4A:
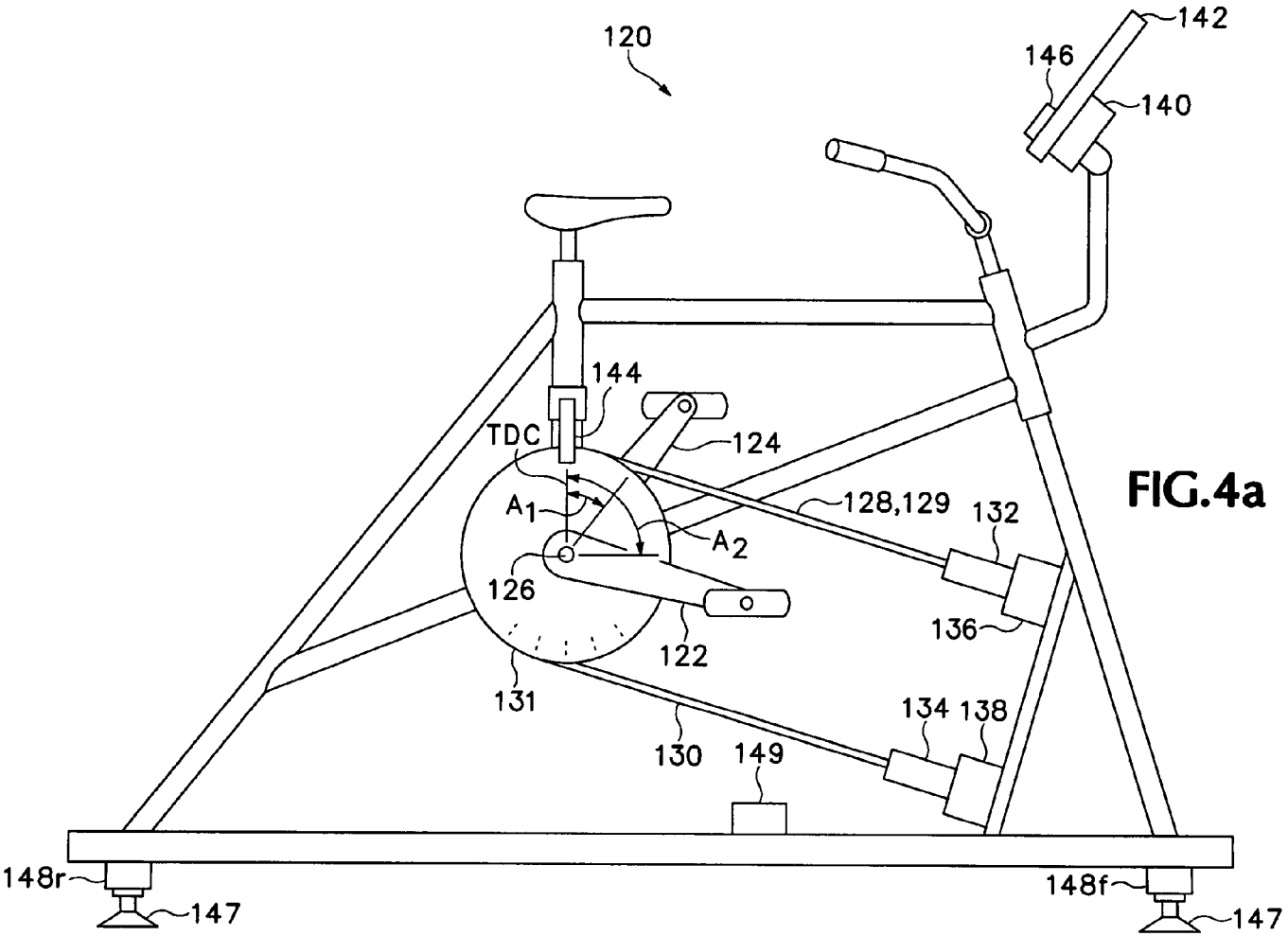

FIG. 4*a* is a simplified view of an exercise machine which is another preferred embodiment of the present invention.

Figure 4B:
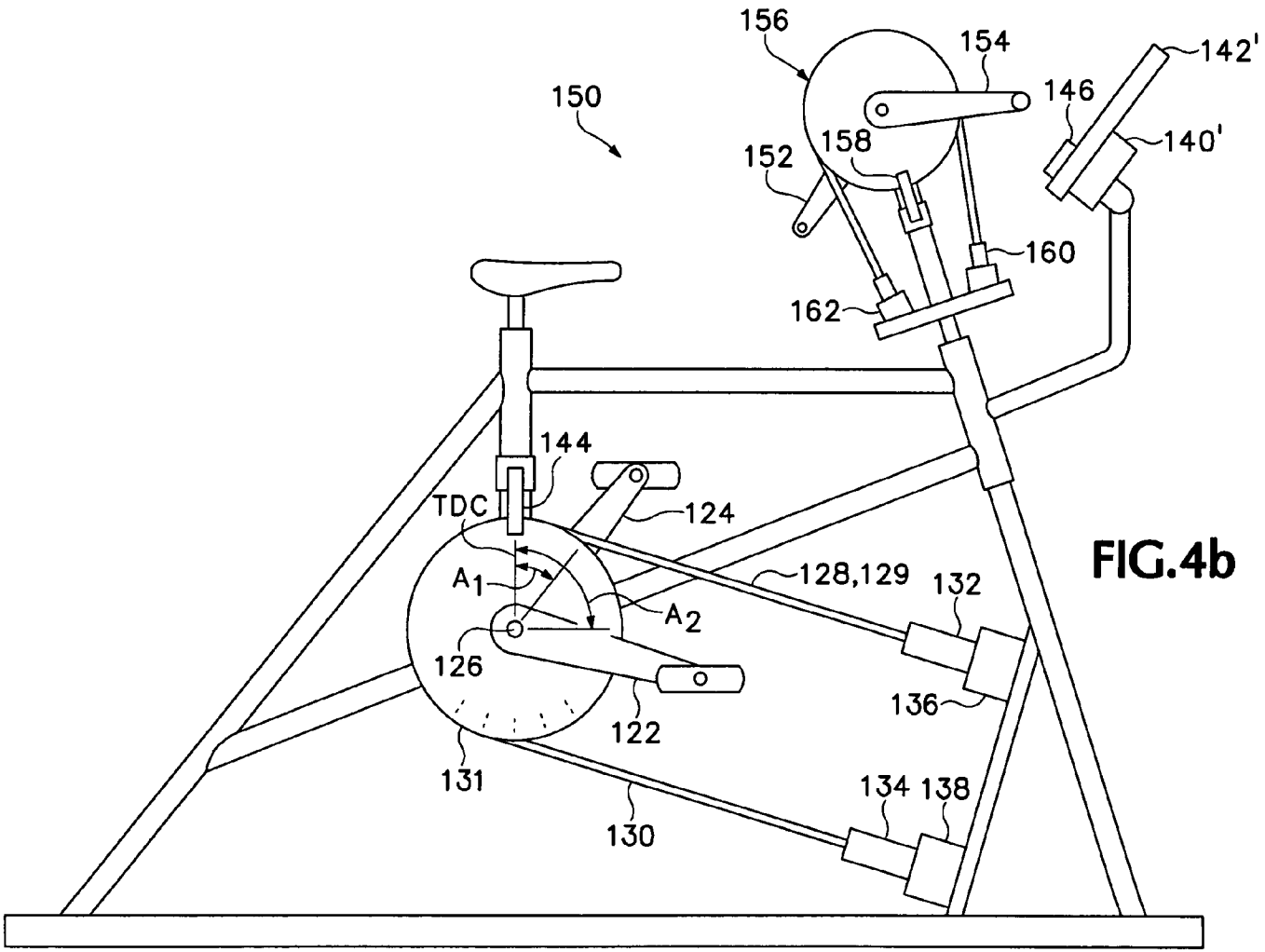

FIG. 4*b* is a simplified view of an exercise machine which is another preferred embodiment of the present invention.

Figure 5:
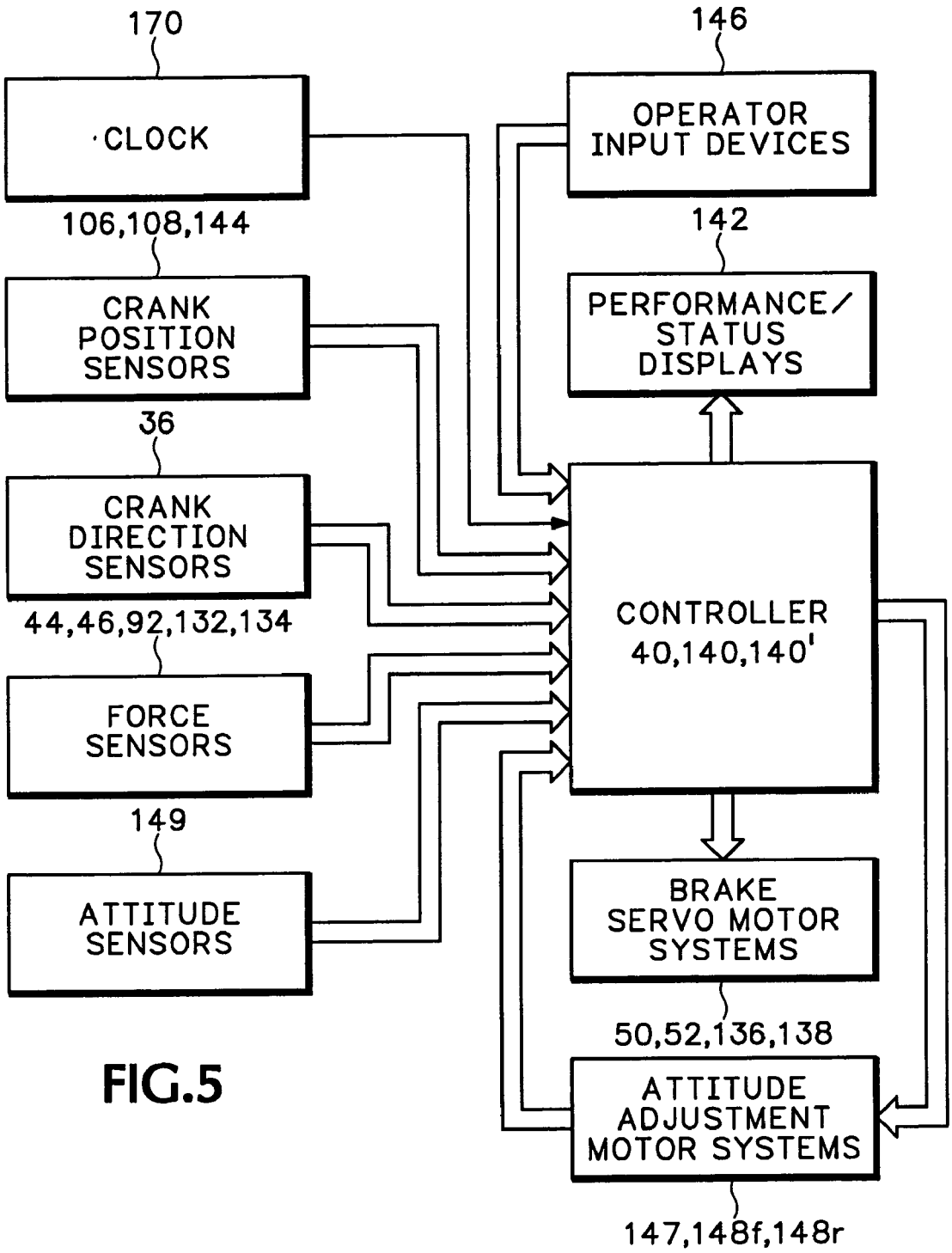

FIG. 5 is a block diagram of a control system for a preferred embodiment of the present invention.

Figure 6A:
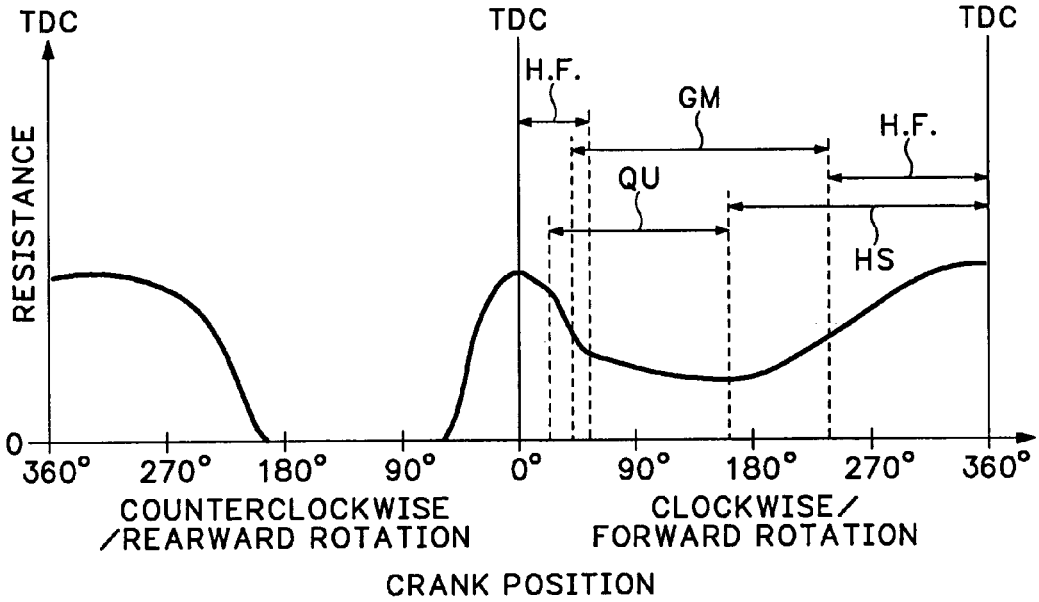

FIG. 6*a* is a graphical representation of one possible pattern of application of resistance to a single rotation of one of the cranks of an exercise machine according to the present invention.

Figure 6B:
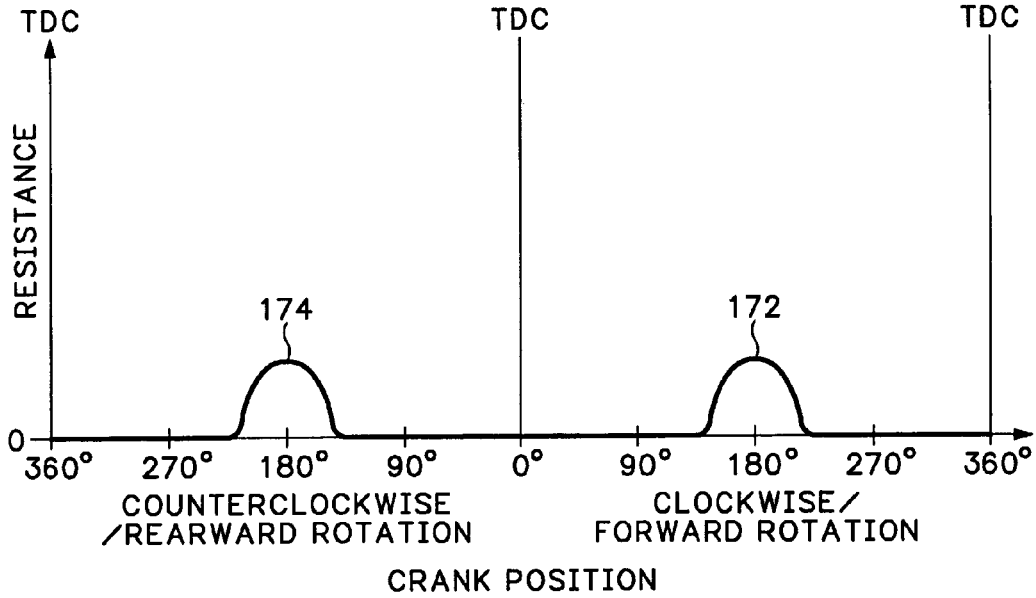

FIG. 6*b* is a graphical representation of one possible pattern of application of resistance to a single rotation of one of the pedal cranks of an exercise machine according to the invention to simulate the forces to be borne by a leg during running to allow an exercise bicycle to better train runners according to the present invention.

DETAILED DESCRIPTION OF PREFERRED EMBODIMENTS

Figure 1:
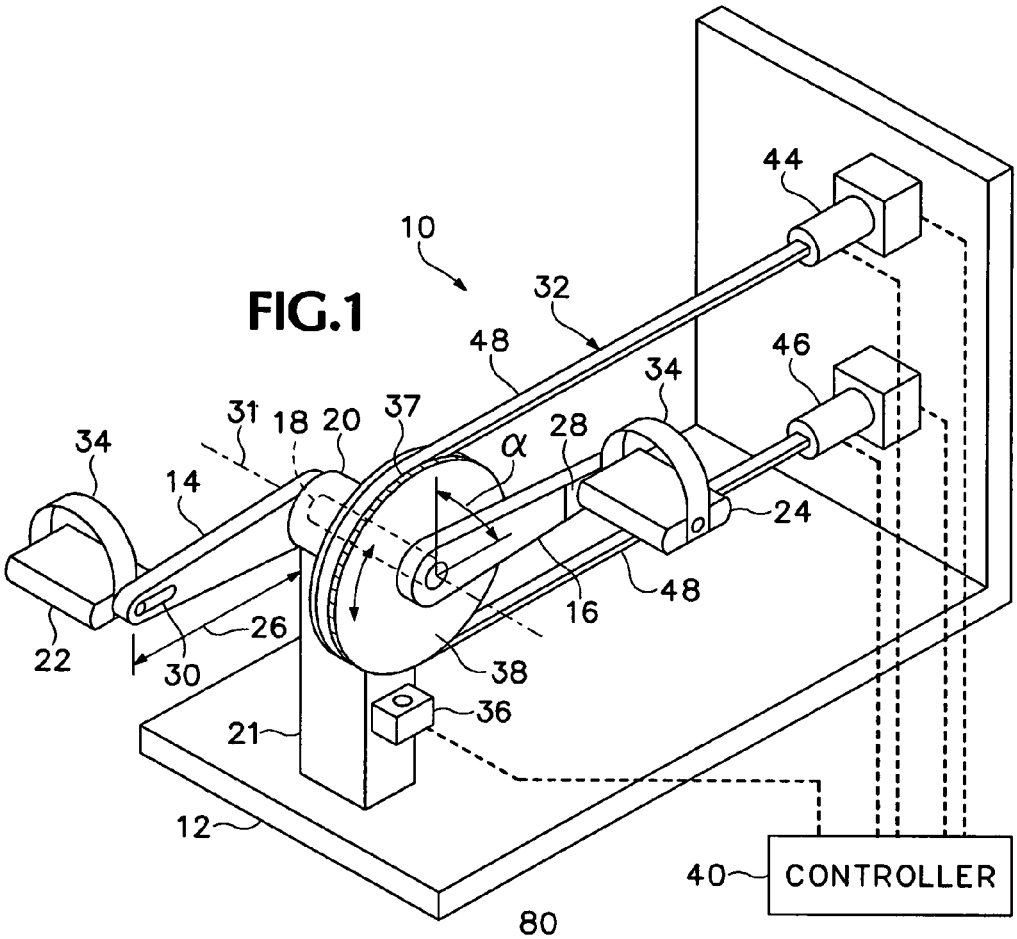
FIG. 1 is an isometric view of an apparatus including a schematically represented controller and a braking mechanism embodying a first aspect of the present invention.

Referring to the drawings that form a part of the disclosure herein, an exercise apparatus 10 shown in FIG. 1 has a frame 12 on which a pair of cranks 14, 16 are mounted on a crankshaft 18 carried in suitable bearings 20 mounted at the top of the upright support member 21. The cranks 14, 16 carry pedals 22, 24 that may be attached at an adjustable distance 26 from the crankshaft 18, as by being mounted rotatably on a respective mounting plate 28 fastened to the crank 14 or 16 by a suitable fastener extending through a slot 30 defined in the crank.

Each crank 14, 16 is connected drivingly to the crankshaft 18, so that either of the cranks 14, 16 can independently cause the crankshaft 18 to rotate about an axis 31. An adjustable braking mechanism 32 is mounted on the frame 12 and can be operated quickly and precisely to provide increased or decreased resistance to rotation of the shaft. The braking mechanism can be of any of several types so long as the braking force can be reliably and controllably varied.

Each of the pedals includes a strap or a foot clip 34 or other device for use in attaching a person's foot to the respective pedal 14 or 16. Instead of having clips 34, the pedals 14, 16 could be clipless bicycle pedals and the user could use appropriate shoes that mate with the pedals 14, 16, so that force can be applied to the pedals in any direction including away from or toward the user. The braking mechanism 32 can be adjusted to provide resistance which can be overcome by one leg, for example by a healthy leg. Either pedal 14, 16 can be rotated in either a forward or an opposite, backward direction with the brake mechanism 32 providing frictional resistance. Since the positions of the pedals 14, 16 are independently adjustable to a desired crank arm length 26, the exercise machine 10 can accommodate use by persons whose range of motion may be limited, or who have legs of different lengths. If desired, one of the cranks 14 and 16 could be omitted, and only one leg need be used.

At least one sensor 36 is arranged with the members that rotate together as a unit with the cranks 14, 16, including the crankshaft 18 and a brake drum 38, in order to determine at any time the position angle $\alpha$ of the cranks 14, 16 with respect to a reference position such as top dead center. The sensor 36 provides one or more signals useable by a controller 40. From a series of such signals indicating the instantaneous angular position of the cranks 14, 16 over a period of time can determine the direction of crankshaft rotation, the angular velocity, and the rate of acceleration. The sensor 36 must be capable of determining the angular position of the cranks 14, 16 with a sufficient amount of precision; for example, the sensor 36 should be able to determine the position of the crank within 5 degrees of angle and preferably within one degree or less, and able to do so frequently, as at times separated by 0.01 seconds or less.

The sensor 36 preferably includes a suitable electronic position sensing device and is preferably located adjacent a corresponding side of the frame 12, to be used in observing the instantaneous position of the crank 14, 16. For example, markings such as a suitable optical reticle 37 may be provided in a convenient location on the brake drum 38, so that an electronic optical scanner included in the sensor 36 may be used to detect movement of the brake drum 38 and develop a useful electronic signal indicative of the position. Such an electronic signal, preferably a digital signal, provides a basis for calculating angular movement and speed of the brake drum 38 and thus of the crankshaft 18 and the attached cranks 14, 16. Alternatively, one or more suitable Hall effect devices or other electromagnetic position sensing devices (not shown) may be used to provide an electrical signal indicating the positions of the cranks 14, 16.

Preferably, a force sensor separate from the position sensor 36 is also included to provide a signal representative of the amount of force effectively being exerted on a crank 14, 16 as it is being rotated. Such a sensor could, for example, be associated with a brake system such as the drum and band brake mechanism 32, as by including suitable strain gauges 44, 46 associated with each end of the brake band 48 to provide output signals representative of the tension in the brake band 48. The difference in detected strain between the two strain gauges 44, 46 is representative of the torque being exerted by the brake mechanism 32 in opposition to movement of the cranks 14, 16. While this arrangement does not inherently account for the aggregate moment of inertia of the members of the rotating unit including the cranks 14, 16, crankshaft 18, and brake drum 38 etc., the aggregate moment of inertia of the rotating members can be determined, and calculations can be utilized if desired to account for that inertia in determining from the signals representing the tension in the brake band 48 the actual amount of force applied to the crank or cranks.

Figure 2:
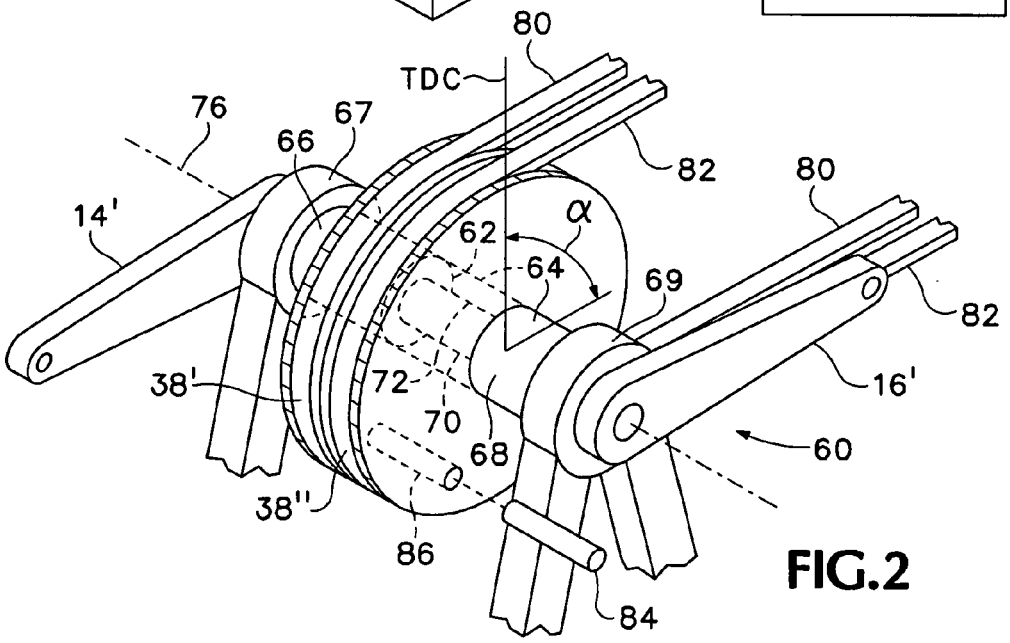
FIG. 2 is a partially cutaway isometric view of a shaft and crank arrangement which form part of another embodiment of the present invention.

Referring also to FIG. 2, a crank subassembly 60 for an exercise machine is in several ways similar to that of the exercise machine shown in FIG. 1. The exercise machine shown in FIG. 2, however, is different in that there are a pair of concentric shafts herein after called half-shafts 62 and 64, having respective outer ends 66, 68, each supported in its own separate set of bearings 67, 69, while an inner end 70 of the left half-shaft 62 extends into a central bore 72 in the right half-shaft 64, where it fits closely but rotatably, and each half-shaft 62, 64 is thus supported for rotation about a common axis of rotation 76 either together with or at a speed differential with respect to the other half-shaft. The inner end 70 may be supported simply within journal bearings defined by the right half shaft 64, while the outer end 66, 68 of the halfshafts are supported in anti-friction bearings 67, 69, since the inner and outer shafts ordinarily would not rotate a great deal with respect to each other during use of the exercise machine, assuming a user is using both legs, but each leg must independently rotate one of the cranks 14' and 16' throughout each revolution. Depending on the intended use of the exercise machine, each separate pedal and half-shaft may be balanced separately about the axis of rotation 76.

Preferably, a pair of separately adjustable brake mechanisms 80 and 82 are associated respectively with the rotating unit including each of the half-shafts 62 and 64 to provide separately a desired amount of resistance to rotation for each one of a pair of cranks 14', 16', and separate sensors (not shown) are provided to sense the position and movement of each of the cranks. While the brake mechanisms 80 and 82 could be of any of various types, they are shown for convenience as being of the drum and band types as in FIG. 1 and each includes respective components similar to those of the brake mechanism 32 and therefore is not shown in complete detail in FIG. 2. While each brake mechanism 80 or 82 ordinarily will provide resistance to rotation of the respective rotating unit in either direction, a brake mechanism operably arranged to resist rotation in one direction but not resist rotation in the opposite direction may also be employed. By adjusting each brake mechanism 80, 82 to provide an amount of resistance to rotation of one of the cranks 14' or 16' that is suitable in respect of the strength and condition of training of the respective leg or arm of the person using the exercise machine, an appropriate amount of exercise may be accomplished by rotating both cranks 14 and 16' in a coordinated fashion. The subassembly 60 preferably includes a mechanism, such as a removable pin 84 and bores 86 defined in the side-by-side brake drums 38' and 38" that can be aligned to receive the pin 84, for selectively locking the half-shafts 62, 64 together with the cranks 14', 16' in desired positions with respect to each other, usually either opposed by 180° or side by side.

Figure 3:
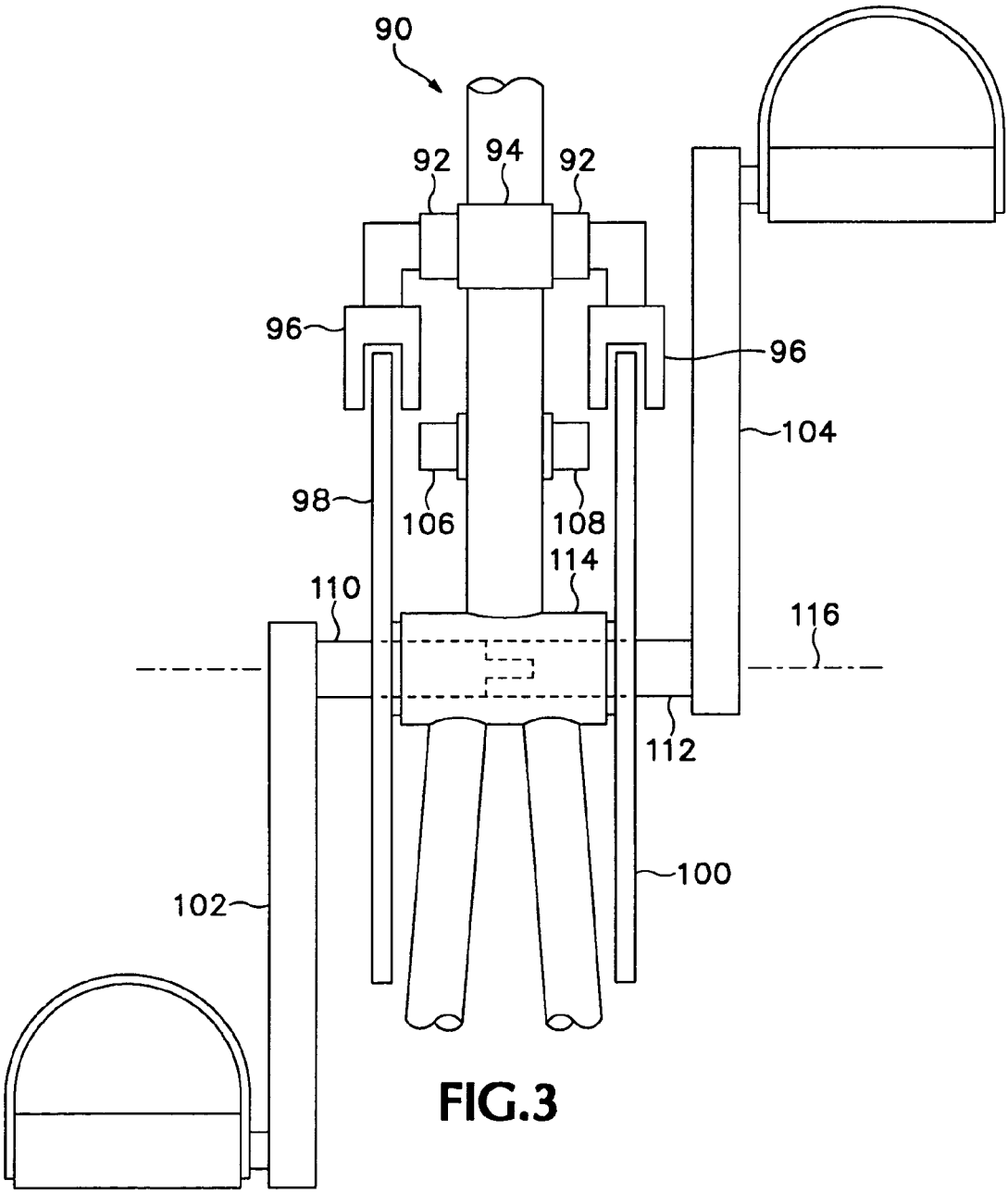
FIG. 3 is a simplified view of a subassembly including a shaft, crank, and brake arrangement in another embodiment of the invention.

Other strain gauge arrangements could be utilized with other brake systems. For example, in a subassembly 90 for an exercise machine, shown in FIG. 3, suitable strain gauges 92 might be incorporated in the mounting structures 94 for the friction producing calipers 96 of a pair of disc brakes whose rotors 98, 100 are rotated by the cranks 102, 104 or their respective crankshafts. A suitable grating or reticle may be provided on each rotor to be sensed by optical sensors 106, 108, or if using suitable optical Doppler sensor technology, no reticle is necessary to determine direction and speed of rotor angular movement, although a reference marking may be needed to determine or verify the angular position of each rotor 98 and 100. Crankshafts 110, 112 may be arranged in the same manner as the halfshafts 62, 64, as shown in FIG. 2, with suitable bearings at each side of a housing 114 similar to a bottom bracket of a bicycle and the inner end of the left crankshaft 110 concentrically fitted rotatably inside the inner end of the right shaft 112, so that both crankshafts 110, 112 rotate about the same axis of rotation 116.

The calipers 96 of the brakes may be activated by remote control, using hydraulic, cable or electrical connections of well-known types to cause each caliper 96 to provide desired amounts of brake frictional resistance to rotation of each rotor 98 and 100 at desired respective angular positions of the cranks 102 and 104.

In any case each rotating unit including a shaft, a crank, and an associated brake rotor will have a certain moment of inertia. A brake rotor could also be designed as a flywheel to have a desired larger moment of inertia, or each crank could be arranged to drive a separate flywheel (not shown) having a desired moment of inertia at a multiplied rate of angular velocity, by a suitable belt or chain arrangement (not shown). However, each such rotating unit of a shaft, a crank, and a brake rotor preferably has only a small moment of inertia, so that each crank can be rotated using a minimal effort, apart from the effort required to overcome the resistance provided intentionally by the respective associated brake mechanism, and a larger inertia flywheel resistance can be simulated using external control of the brake mechanism restricting rates of acceleration if such simulation would be desirable for the desired training or rehabilitation goal. This also minimizes the amount of assistance given by momentum of such a rotating unit to the muscles in need of training.

In use of either the exercise machine 10 or an exercise machine including the subassembly 60 or the subassembly 90, specific training of different muscle groups may be accomplished in part by appropriately locating the exercise device with respect to the person using it, so that the effects of gravity require use of different muscles. For example, by positioning the user on a seat located generally above the axis of rotation 31 of the exercise machine 10 greater exertion by use of the hip and knee flexor muscles may be required to raise the pedal 14 or 16 to the top of its rotation because of the need to lift the weight of the massive thigh against gravity. When the user is seated with his or her hips level with or below the axis of rotation 31, as on a recumbent bicycle, different muscles are used to raise the pedals 14 and 16 to the tops of their paths of rotation and exertion requirements of those muscles could be further augmented by adding weights to the user's ankles or the pedal. When the apparatus 10 is arranged in connection with a bench on which the user can lie face down with the crankshaft located near the height of the bench still other muscle sets can be emphasized.

Referring now to FIG. 4*a*, an exercise machine 120 similar to a stationary bicycle is equipped with a pair of pedal cranks 122, 124 arranged generally as are the cranks 14' and 16' in the subassembly 60 shown in FIG. 2, to rotate independently of each other, about an axis of rotation 126. Suitable sets of bearings support a pair of coaxial crankshafts that may be similar to the half shafts 62, 64, shown in FIG. 2, and the shafts 110, 112 shown in FIG. 3, so that the cranks 122, 124 are free to rotate with respect to each other.

A left brake mechanism 128 and a right brake mechanism 129 are mounted on the frame of the exercise machine 120 and are respectively engaged to resist rotation of each crank. While the brakes 128 and 129 could be actuated mechanically by a suitable servo system and a mechanical cable arrangement (not shown), the brakes preferably are operated more directly and precisely than is practical using a cable arrangement, as for example by electrical actuation through the use of suitable solenoids arrangement to provide a desired amount of braking force that can be varied instantaneously in response to a controlling signal.

The brake mechanisms 128 and 129 may, each be similar to the brake mechanism 32 described above, for example, and each may include a respective brake band 130, brake drum 131, associated with the respective one of the cranks 122 and 124, suitable strain gauges 132 and 134 and electrically controlled motors 136 and 138 connected with the frame of the exercise machine 120 so as to provide the required amount of tension in the brake bands 130. A controller 140 may be connected electrically with each strain gauge 132 or 134 and brake motor 136 and 138 through suitable conductors (not shown). A display module 142 is preferably associated with the controller 140 to provide desired indications relating to the performance of a person utilizing the exercise machine 120. At least one sensor 144, comparable to the sensors 106 and 108 used in the subassembly 90, is also electrically interconnected with the controller 140 to provide frequent indications of the angular position of each crank 122 or 124, as previously described with respect to the sensor 36 utilized with the apparatus 10 described above. The display module 142 may also have an associated user input module 146 through which various information and instruction can be entered into the controller 140 by the user, a coach, or a health professional setting the exercise machine up for a user.

A respective support 147 may be provided at each end of the exercise bicycle 120. A front attitude adjustment motor 148*f* and a rear attitude adjustment motor 148*r* are mounted between the supports 147 and the base of the frame of the exercise bicycle 120, and a pitch sensor 149 is suitable located on the exercise bicycle to sense the attitude of the exercise bicycle, the motor and sensors also being interconnected with the controller 140 by suitable conductors (not shown). Alternatively, attitude adjustment can be accomplished with a single front or rear mechanism suitably designed.

Referring to FIG. 4*b*, an exercise machine 150 is similar to the exercise machine 120 in many respects, but also includes a pair of hand cranks 152 and 154. Each hand crank has an associated brake mechanism 156, illustrated in FIG. 4*b* as a drum and band type brake, for the sake of simplicity and consistency. Each hand crank 152 or 154 and brake mechanism also has an associated sensor 158 capable of determining the position of the respective hand crank. Suitable sensors, such as strain gauges 160, are provided for use in determining how much resistance to hand crank rotation is being provided by each brake mechanism 156. Each brake mechanism 156 has an associated electrically controllable actuating mechanism 162 by which the respective brake mechanism 156 can separately be controlled precisely and quickly so that a desired amount of resistance to the rotation of each hand crank 152, 154 can be provided at the desired angular position of each hand crank 152 and 154. The sensors and brake control mechanisms associated with the hand cranks 152 and 154 are electrically connected with the controller 140' and display module 142'.

As shown in FIG. 5, a controller 140 may be used to electrically control respective servo systems utilized to operate each brake mechanism of an exercise machine embodying certain aspects of the invention. Signals provided by various sensors such as the crank position sensors 36, 106, 108, 144, and 158 previously mentioned, the separate crank direction sensors if provided, and brake force sensors such as the strain gauges 44, 46, 92, 132, 134, and 160, and various manual inputs are received by the controller 140, which in turn produces output signals to control the brake servo motor systems 50, 52, 136, and 138 operating the brake mechanisms, and to provide a display of data on a display 142 or other display, relating to the user's performance of the exercise machine 10, 60, or 90. The controller 40, 140, or 140' may include a suitably programmed digital microprocessor, associated memory, data-input devices, data-output devices, and output signal devices arranged to control motors 50, 52, 136, 138, etc. arranged to operate the brake mechanisms mechanically, or to control equivalent components to operate a brake mechanism of a different sort, such as one in which fluid viscosity is electrically controlled to provide resistance as desired, or in which an electric eddy current brake is utilized with a flywheel rotated at a multiple of the rotation speed of the crank 122 or 124. While a dedicated microprocessor is preferably utilized in the controller, the required data acquisition, control, and data display functions can also be performed by a suitably programmed personal computer connected externally to the device.

Preferably, the controller 40, 140, or 140' uses digital electrical signals, as from a clock 170 representative of the length of time during which the exercise machine is operated for a particular workout and to calculate speed, distance, acceleration, etc. Signals, preferably in digital form, representative of the instantaneous position of each crank, and the instantaneous value of the component of force exerted on each crank in the direction required to rotate the particular crank are provided to the controller 140, among others. As mentioned above, preferably at least one sensor such as the sensors 36, 144, 158 is arranged to detect the direction in which each crank 122, 124, 152, 154, etc. is moving. For example, a scanner and various patterns of optical scanner reticle markings on a rotor or crankshaft, or an optical Doppler effect sensor such as is well known for use in an optical mouse for a computer, may be utilized to detect direction of crank movement.

For use of the exercise machine as part of therapeutic training, the controller 40, 140, or 140' may be set to provide a predetermined amount of resistance to rotation of either or each crank 14, 16, 122, 124, 152, or 154 through one or more selected angular sectors of each rotation of the crank in a particular direction, in order to require a selected level of exertion by a selected muscle or group of muscles acting to rotate the crank in a desired direction through the desired angular sector or sectors of its rotation about the central axis of rotation 31, 76, or 126 of the crankshaft.

While theoretically it would be possible to calibrate certain brake mechanisms so that the controller can provide a certain output signal to the brake control servo system in response to entry of a desired amount of resistance into the control system through an operator input system, a more convenient control system uses as feedback a measurement of the actual effective component of force being exerted at a particular time to rotate each crank. The actual value of such a component of force being exerted at a particular time may be calculated by the controller 40, 140, or 140' through use of a respective properly calibrated strain gauge arrangement associated with each brake to provide an electrical output signal to the controller 140 in digital form, as an indication of the force effectively being applied at any instant to the respective crank. Suitable strain gauges for use in such an arrangement are known, for example, for use in digital weighing scales. Such a strain gauge might be mounted, for example, in a structure utilized to support a friction-producing portion of a brake mechanism with respect to the frame of the exercise machine, such as a strain gauge 92 associated with a disk brake caliper mounting 94 shown in FIG. 3, assuming that the effort required to rotate each crank 102, 104, etc. is negligible when the brakes are not engaged to resist the movement of the cranks. That is, the effective force applied to a crankshaft and brake rotor of negligible total mass resisted primarily by the brake will cause detectible strain between the appropriately mounted brake and the frame of the exercise machine.

Where a flywheel, brake drum, brake disk, or other rotor of non-negligible mass is rotated by the crank, the controller 40, 140, etc. can also calculate the amount of force being applied to the crank to overcome system inertia. By utilizing frequent signals representative of the instantaneous position of a crank correlated with a time signals from the clock 170, the controller 140 can calculate angular velocity and acceleration of a crank to determine the amount of force being applied to the crank to overcome inertia, in addition to force used to overcome brake resistance as calculated from brake strain measurements, on the basis of the known moment of inertia of the crank and associated rotating system.

The crank position signals (and direction signals, if separately available) from the sensors 106, 108, 144, etc. can be processed by the controller to determine frequently and separately for each crank the instantaneous angular velocity, the instantaneous rate of acceleration, the direction of movement, and the total angular distance through which the particular crank has been rotated.

Preferably, the controller 140 and brake operating servo motors 138, 138, etc., actuate the brake mechanisms so as to provide resistance to crank movement that varies at a desired rate and to a desired value. That is, the brake mechanisms are preferably controlled so as to increase and decrease resistance to rotation of the respective cranks gradually enough so that a user of the exercise machine 60, 90, or 120 is not injured by excessively sudden application or release of a brake, yet so as to be applied or released rapidly enough to provide the appropriate crank "feel" as desired for the specific application.

For example, for a rehabilitation patient having the left leg in good physical condition, while the right leg, perhaps as a result of an injury, is relatively weak and unable to exert a normal amount of force in the direction of extension of the leg, the controller 40 or 140 can be programmed by a user or a physical therapist to cause the brake mechanism on the right crank to provide a reduced amount of resistance through a certain angular sector of the rotation of the crank, as shown graphically in FIG. 6*a*. By way of example and depending upon how a user is positioned on the machine, in FIG. 6*a* are shown arrows H.F. indicating the approximate portion of a forward rotation of a crank where the hip flexors are in use, an arrow G.M. indicating use of the gluteus maximus, an arrow Q.U. indicating use of the quadriceps, and an arrow H.S. indicating the range of use of the hamstring muscles.

In another example, for rehabilitation or training of a runner's leg muscles and coordination, the exercise machine 60, 90, or 120 might be programmed as shown in FIG. 6*b* to provide minimal resistance to rotation of a pedal crank 122 or 124 as the user's leg is moved in the "recovery" portion of the running motion, and then provide resistance through a small angular sector of a rotation, as shown at 172 in the illustrated resistance curve, to simulate the reaction force encountered as a runner's foot is in contact with the ground during a running stride. The exercise machine 60, 90, 120 might also be appropriately programmed to simulate backwards running, as shown by the curve at 174.

As mentioned above, an apparatus such as that shown in FIG. 4*a* can also be utilized as an exercise machine to provide a workout for a healthy individual, by controlling the resistance to rotation of each of the cranks 122, 124 to simulate realistically the variations in exertion necessary to ride a real bicycle on a computer-simulated course including uphill and downhill portions of different lengths and slopes as well as level or nearly level portions, so that the force needed to be applied to each of the cranks 122 and 124 is controlled by application of the respective one of the brake mechanisms 128, 129 in programmed response to the user's efforts in negotiating a programmed or simulated course simulating varied up or down slopes along a roadway at various positions along the programmed course. Such a programmed simulated course could include inputs of up slope angle, down slope angle, and simulated distances to be covered.

The controller 140 would be programmed to utilize the crank position sensor signals to determine the instantaneous position of each of the cranks 122, 124, and to calculate crank speed, crank acceleration, simulated bicycle speed, and simulated distance traveled along a programmed simulated course, taking into account the number of crank rotations and a simulated chainring and cog combination selected by the user during a workout on the exercise machine 120. The controller 140 is programmed in a suitable manner to increase the amount of resistance to rotation of each crank according to a predetermined schedule in response to factors such as increased crank speed, increased simulated bicycle speed, increased upward slope or decreased downslope, increased user weight, shifting up to a higher speed simulated chainring and cog combination, and increased opposing relative windspeed. The controller 140 may correspondingly be programmed to decrease the amount of brake resistance to rotation of the cranks 122 and 124 in response to various factors including decreased simulated bicycle speed, decreased upslope or increased downslope, shifting to a chain ring and cog combination providing a lower gear ratio, lighter user weight, or an aiding relative wind speed. Increased or continued downslope can result in increased speed of an actual bicycle, simulated by operation of the controller 40 applying no resistance to crank rotation as long as crank speed is less than would be necessary to further accelerate the bicycle moving at the simulated speed using a simulated gearing selection. In this way "coasting" under any condition can be appropriately simulated.

The bicycle can be moved by the attitude adjustment motors 148*f* and 148*r* to achieve a pitch angle measured by the pitch sensor 149 in response to signals from the controller 140, to simulate climbing or descending a hill in a simulated course. Thus the frame can be adjusted to a 6% pitch to simulate a 6% slope on the simulated course, for example. While some of the above-mentioned factors may be omitted, the more that are included in programming the controller 140 and providing for related inputs through the input module 146, the more realistic will be the resulting simulated ride experience.

Preferably, in such an exercise machine the input module 146 can accept and communicate to the controller 140 various additional manual inputs such as a user's weight, the type of bicycle being simulated, and even wind speed, and thus can provide resistance to rotation of the cranks 122 and 124 simulating the effort required according to such additional inputs, in order to provide a realistic simulation of the effort required of a particular user to cycle in a particular part of a chosen programmed simulated course.

In a preferred embodiment of the invention, a user may also provide a signal to the controller indicating a simulated selection of a chain ring and cog combination, in order to control the amount of effort required at various points along a simulated course, and the controller 140 will both adjust the resistance that should be provided by the brake mechanisms 128 and 130 and recalculate the number of crank rotations required to simulate traveling a portion of the programmed simulated distance in each selected gear ratio.

Some athletes need to develop endurance in selected muscle groups to exert force and to be able to move their limbs alternatingly and repetitively through distances in opposite directions for considerable lengths of time. For example, swimmers may desire to train certain muscle groups which can be used in kicking, by moving a pair of cranks 122, 124 in alternating directions against suitable resistance in each direction. The controller 140 preferably can be programmed accordingly to detect and respond to the direction of movement of each crank 122 and 124, as well as its position, and to provide an appropriate amount of braking resistance to movement of each crank 122 and 124 in each direction of crank movement, according to a prescribed pattern expected to be useful for strengthening and increasing endurance of the appropriate muscle groups, while those muscle groups are being used in an appropriate coordinated fashion such as the alternating back and forth movement of the swimmer's flutter kick or the concurrent back and forth motion of the swimmer's dolphin kick.

The user or coach or trainer may therefore program the controller 140 to provide desired amounts of resistance to movement separately in each direction through certain selected angular sectors of rotation of each crank, such as between selected crank positions measured as angles $A_1$, $A_2$, etc. about the axis of rotation 126 in a selected direction from a reference point such as top dead center (TDC). It may also be desirable in some training programs to program the controller 140 to provide brake resistance in different amounts and in different angular sectors depending on the direction of movement of each crank 122 or 124, or to provide a first amount of resistance through a first angular sector of rotation in a first direction, and to provide a somewhat different amount of resistance at the same crank location or through a different but possibly overlapping angular sector of crank motion in the opposite direction, as depicted graphically in FIG. 6.

The terms and expressions which have been employed in the forgoing specification are used therein as terms of description and not of limitation, and there is no intention in the use of such terms and expressions of excluding equivalents of the features shown and described or portions thereof, it being recognized that the scope of the invention is defined and limited only by the claims which follow.

The invention claimed is:

1. An exercise machine, comprising:

(a) a frame;

(b) a first crank mounted rotatably on said frame for multiple rotations about an axis of rotation with respect to said frame;

(c) a first adjustable brake mechanism, arranged to provide during each of said multiple rotations a first selected amount of resistance to rotation of said first crank with respect to said frame as said first crank is moved through a first predetermined angular sector of each of said rotations of said first crank, and arranged to provide during each of said rotations a different second selected amount of resistance to rotation of said first crank with respect to said frame as said first crank is moved through a second predetermined angular sector of each of said rotations of said first crank;

(d) a brake sensor associated with said first adjustable brake mechanism and arranged to detect and evaluate said amounts of resistance to rotation being applied to said first crank by said first adjustable brake mechanism;

(e) a position sensor arranged to sense and provide an indication of an angular position of said first crank during each of said rotations at times when said brake sensor detects said amounts of resistance; and (f) a controller arranged to receive a plurality of input signals and to cause said first adjustable brake mechanism to regulate said resistance to rotation of said first crank in response to each of said plurality of input signals, and wherein said controller periodically computes a total amount of rotation of said first crank during a period of use of said exercise machine and causes said first adjustable brake mechanism to adjust said resistance to rotation of said first crank in response to a predetermined total amount of rotation.

2. The exercise machine of claim 1 wherein said brake sensor is arranged so as to determine and provide an indication of said amount of resistance being provided when said first crank is in a selected angular position with respect to said frame.

3. The exercise machine of claim 1 including a second crank mounted rotatably on said frame for rotation about said axis of rotation independent from said first crank.

4. The exercise machine of claim 3 including a second brake mechanism arranged to provide resistance to said second crank independently from resistance provided by said first adjustable brake mechanism.

5. The exercise machine of claim 1 wherein said first and second selected amounts of resistance are separately adjustable.

6. The exercise machine of claim 1 wherein said first adjustable brake mechanism is capable of being operated so as to vary said first and second angular sectors.

7. The exercise machine of claim 1 wherein said first adjustable brake mechanism includes an electrically controlled brake.

8. The exercise machine of claim 1 including a servo system arranged to receive an indication of said angular position of said first crank and to adjust said first adjustable brake mechanism in response to said angular position of said first crank during rotation of said first crank about said axis.

9. The exercise machine of claim 1 wherein said position sensor is arranged to provide to said controller a signal indicating said angular position of said first crank during operation of said exercise machine.

10. An exercise machine comprising:

(a) a frame;

(b) a first crank mounted rotatably on said frame for multiple rotations about an axis of rotation with respect to said frame;

(c) a first adjustable brake mechanism, arranged to provide during each of said multiple rotations a first selected amount of resistance to rotation of said first crank with respect to said frame as said first crank is moved through a first predetermined angular sector of said rotation of said first crank, and arranged to provide during each said rotation a different second selected amount of resistance to rotation of said first crank with respect to said frame as said first crank is moved through a second predetermined angular sector of said rotation of said first crank;

(d) a brake sensor associated with said first adjustable brake mechanism and arranged to detect and evaluate said amounts of resistance to rotation being applied to said first crank by said first adjustable brake mechanism;

(e) a position sensor arranged to sense and provide an indication of an angular position of said first crank during said rotation at a time when said brake sensor detects said amounts of resistance; and (f) a controller arranged to cause said first adjustable brake mechanism to provide a controlled amount of resistance to rotation of said first crank in addition to said first and second selected amounts of resistance during an exercise session to require a predetermined amount of pedaling effort so as to simulate pedaling effort required for riding a bicycle.

11. The exercise machine of claim 1 wherein one of said input signals is a signal from said position sensor indicative of said angular position of said first crank.

12. The exercise machine of claim 10 wherein said controller is arranged to receive a plurality of input signals and to cause said first adjustable brake mechanism to regulate said resistance to rotation of said first crank in response to each of said plurality of input signals.

13. The exercise machine of claim 12 wherein said controller periodically computes a total amount of rotation of said first crank during a period of use of said exercise machine and causes said first adjustable brake mechanism to adjust said resistance to rotation of said first crank in response to a predetermined total amount of rotation.

14. The exercise machine of claim 10 wherein said controller causes said first adjustable brake mechanism to vary said controlled amounts of resistance to rotation of said first crank in response to angular velocity of said first crank.

15. The exercise machine of claim 10 wherein said controller causes said first adjustable brake mechanism to vary said controlled amounts of resistance to rotation of said first crank in response to determining that said first crank has been rotated through each of a predetermined set of amounts of total crank rotation during an exercise session and wherein said controller thereby varies said predetermined amount of pedaling effort so as to simulate riding a bicycle over a course including a series of various slopes.

16. The exercise machine of claim 10 wherein said controller causes said first adjustable brake mechanism to vary said controlled amounts of resistance to rotation of said first crank in response to a signal representative of angular velocity of said first crank, and simultaneously to vary said controlled amounts of resistance to simulate a slope along a course including a series of various simulated slopes to require a predetermined amount of varying pedaling effort during an exercise session simulating riding a bicycle along said course.

17. The exercise machine of claim 10 wherein said controller is arranged to cause said brake mechanism to vary said controlled amounts of resistance to rotation of said first crank in response to an input signal representative of a user's weight.

18. An exercise machine, comprising:

a frame;

(b) a first crank mounted rotatably on said frame for multiple rotations about an axis of rotation with respect to said frame;

(c) a first adjustable brake mechanism, arranged to provide during each of said multiple rotations a first selected amount of resistance to rotation of said first crank with respect to said frame as said first crank is moved through a first predetermined angular sector of said rotation of said first crank, and arranged to provide during each said rotation a different second selected amount of resistance to rotation of said first crank with respect to said frame as said first crank is moved through a second predetermined angular sector of said rotation of said first crank;

(d) a brake sensor associated with said first adjustable brake mechanism and arranged to detect and evaluate said resistances to rotation being applied to said first crank by said first adjustable brake mechanism;

(e) a position sensor arranged to sense and provide an indication of an angular position of said first crank during said rotation at a time when said brake sensor detects said resistances; and including (f) a controller, and wherein said first adjustable brake mechanism is controlled by said controller to provide resistance to rotation of said first crank simulating reaction to forces used by a runner in taking a step.

19. The exercise machine of claim 1 including a controller and a motor arranged to operate in response to said controller to adjust a pitch attitude of said exercise machine during operation of said exercise machine.

20. The exercise machine of claim 17 wherein said controller is arranged to cause said brake mechanism to vary said controlled amounts of resistance, by an amount and for a time related to said signal representative of a user's weight, in order to require effort realistically simulating effort that would be required of the user to ride a bicycle.

21. The exercise machine of claim 17 wherein said controller is arranged to cause said brake mechanism to reduce said controlled amounts of resistance, by an amount and for a time related to said signal representative of a user's weight, to allow said crank to be rotated at a speed related to a coasting speed of a simulated bicycle without resistance from said brake mechanism, thereby simulating a pedaling effort required for riding said bicycle while coasting.

22. The exercise machine of claim 18 wherein said resistance to rotation of said first crank simulating reaction to forces used by a runner in taking a step includes a first amount of resistance through a larger first angular sector wherein said first crank is being lifted and thereafter is moving downward, and a second, larger, amount of resistance through a second, bottom, angular sector wherein said second amount of resistance simulates reaction to contact of a runner's foot with a supporting surface as the runner takes a step.

23. The exercise machine of claim 22 wherein said second amount of resistance increases steeply and decreases steeply near leading and trailing margins of said second, bottom, angular sector.

24. The exercise machine of claim 10 wherein said brake sensor is arranged so as to determine and provide an indication of said resistance being provided when said crank is in a selected angular position with respect to said frame.

25. The exercise machine of claim 10 including a second crank mounted rotatably on said frame for rotation about said axis of rotation independent from said first crank.

26. The exercise machine of claim 25 including a second brake mechanism arranged to provide resistance to said second crank independently from resistance provided by said first adjustable brake mechanism.

27. The exercise machine of claim 10 wherein said first and second selected amounts of resistance are separately adjustable.

28. The exercise machine of claim 10 wherein said first adjustable brake mechanism is capable of being operated so as to vary said first and second angular sectors.

29. The exercise machine of claim 10 wherein said first adjustable brake mechanism includes an electrically controlled brake.

30. The exercise machine of claim 10 including a servo system arranged to receive an indication of said angular position of said first crank and to adjust said first adjustable brake mechanism in response to said angular position of said first crank during rotation of said first crank about said axis.

31. The exercise machine of claim 10 wherein said position sensor is arranged to provide to said controller a signal indicating said angular position of said first crank during operation of said exercise machine.

32. The exercise machine of claim 12 wherein one of said input signals is a signal from said position sensor indicative of said angular position of said first crank.

33. The exercise machine of claim 10 including a motor arranged to operate in response to said controller to adjust a pitch attitude of said exercise machine during operation of said exercise machine.

34. The exercise machine of claim 18 wherein said controller is arranged to receive a plurality of input signals and to cause said first adjustable brake mechanism to regulate said amounts of resistance to rotation of said first crank in response to each of said plurality of input signals.

35. The exercise machine of claim 34 wherein one of said input signals is a signal from said position sensor indicative of said angular position of said first crank.

36. The exercise machine of claim 34 wherein said controller periodically computes a total amount of rotation of said first crank during a period of use of said exercise machine and causes said first adjustable brake mechanism to adjust said amounts of resistance to rotation of said first crank in response to a predetermined total amount of rotation.

37. The exercise machine of claim 18 wherein said controller is arranged to cause said first adjustable brake mechanism to vary said amounts of resistance to rotation of said first crank in response to an input signal representative of a user's weight.

* * * * *